United States Patent [19]

Latino et al.

[11] Patent Number: 4,875,526

[45] Date of Patent: Oct. 24, 1989

[54] ROUGH TERRAIN, LARGE WATER VOLUME, TRACK DRIVEN FIREFIGHTING APPARATUS AND METHOD

[76] Inventors: Vincent P. Latino; Sandra L. Latino, both of 6001 S. Park Ave., Space #11, Tucson, Ariz. 85706

[21] Appl. No.: 283,151

[22] Filed: Dec. 9, 1988

[51] Int. Cl.[4] ..... A62C 27/06; A62C 27/08; A62C 27/30

[52] U.S. Cl. ..... 169/24; 169/25; 180/9.46; 239/148; 239/162; 239/165; 239/170; 239/175; 239/289

[58] Field of Search ..... 169/24, 25, 52, 67, 169/70, 54; 239/148, 160, 162, 165, 166, 169, 170, 172, 175, 587, 289; 180/9.4, 9.42, 9.44, 9.46, 14.2

[56] References Cited

U.S. PATENT DOCUMENTS

| | | | |
|---|---|---|---|
| D. 200,918 | 4/1965 | Kachnik | D41/1 |
| D. 286,864 | 11/1986 | Lanzdorf et al. | D12/13 |
| 1,421,496 | 7/1922 | Klewanech | 169/24 |
| 1,835,132 | 12/1931 | Anania | 169/25 X |
| 2,360,397 | 10/1944 | Carpenter | 169/24 |
| 2,984,422 | 5/1961 | Vogt et al. | 169/25 X |
| 3,035,654 | 5/1962 | Nuttall, Jr. et al. | 180/9.44 |
| 3,155,319 | 11/1964 | Hammelmann | 239/191 |
| 3,169,581 | 2/1965 | Cummins | 169/24 |
| 3,187,766 | 6/1965 | Black | 137/267 |
| 3,215,219 | 11/1965 | Forsyth et al. | 180/9.4 X |
| 3,346,052 | 10/1967 | Moore et al. | 169/25 |
| 3,696,878 | 10/1972 | Nelson | 180/9.46 |
| 3,724,554 | 4/1973 | Rupert et al. | 169/52 |
| 3,762,478 | 10/1973 | Cummins | 169/24 |
| 3,770,062 | 11/1973 | Riggs | 169/24 |
| 4,072,203 | 2/1978 | Pierson | 180/9.44 |
| 4,170,264 | 10/1979 | Gibson | 169/24 |

FOREIGN PATENT DOCUMENTS

| | | | |
|---|---|---|---|
| 1191449 | 5/1970 | United Kingdom | 169/24 |

*Primary Examiner*—Joseph F. Peters, Jr.
*Assistant Examiner*—James M. Kannofsky
*Attorney, Agent, or Firm*—Victor Flores; Harry M. Weiss

[57] ABSTRACT

This invention discloses a firefighting track driven apparatus for use in rugged terrain. A crawler track driven tractor vehicle pushes a front platform vehicle and pulls a rear platform vehicle. The front platform vehicle travels on steerable crawler tracks, and is equipped with communication device, directionally controlled lamp system and a water cannon for spraying a fire extinguishing substance. The water cannon is mounted on a telescoping and rotating boom, and has a swiveling nozzle, for accurately aiming the fire extinguishing substance to burning material in difficult places such as treetops. The front platform vehicle has a cab which protects an operator, who operates the boom and cannon and steers the tracks. A reeled firehose arrangement feeds the cannon, and may be lengthened with extension sections to accommodate the telescoping boom. The front platform vehicle is equipped with several tanks for carrying the fire extinguishing substance, to enable the firefighting apparatus to fight fires too remote from water sources for conventional firefighting equipment. The rear platform vehicle carrier reserve tanks of fire extinguishing substance, and a reserve firehose for connection with the cannon.

19 Claims, 4 Drawing Sheets

ROUGH TERRAIN, LARGE WATER VOLUME, TRACK DRIVEN FIREFIGHTING APPARATUS AND METHOD

FIELD OF THE INVENTION

The present invention relates to apparatus for use in firefighting in rugged terrain. More particularly, the present invention relates to a track driven vehicle equipped with an extendible boom water cannon.

DESCRIPTION OF THE PRIOR ART

Fighting forest fires in rugged terrain is both difficult and dangerous. Fires are generally extinguished by dousing them with an extinguishing substance such as water or foam. Delivery of this substance to a forest fire is especially problematic not only because the terrain is frequently quite rugged and remote, but also because of the intense heat produced by the forest fire.

Anciently, the only method of delivering water to a fire was by a bucket brigade. This method is slow because a person cannot carry huge buckets of water for any length of time, and it is dangerous because it requires a relatively large number of people to approach the fire relatively unprotected. Moreover, many forest fires are quite immune to the bucket brigade because of the fires' remoteness from any source of water. Finally, many burning materials in a forest fire may be positioned in places which are physically impossible for people to reach, such as the burning wood in the top of a tree, or a burning tree which is hidden behind a large boulder.

An improved method of delivering the water to the fire was the advent of the pump and hose combination, or the water cannon. By forcing water through a hose at high pressure, the firefighters are able to remain some distance removed from the flames and still deliver water to the burning material. By mounting such a water cannon on a remote control vehicle, the inventions disclosed in U.S. Pat. Nos. 2,360,397 to E. E. Carpenter, 3,724,554 to P. D. Rupert et al., and 3,762,478 to P. F. Cummins enabled the firefighters to remain an even greater distance from the fire.

All of which inventions, however, were simply systems for delivering the water cannon, and not the water. They all relied on their cannons being fed from hoses which they trailed behind them. They therefore were tied to an external water source and failed to address the problem of those fires which are too remotely distanced from any such water source. One modern method of delivering the water to a forest fire has been the use of airplanes and helicopters, but these can carry only rather small amounts of water, and the delivery they provide is rather inaccurate. The water they drop tends to fan out and fall like rain over a relatively large area of the fire.

Therefore, the need exists for a means of safely and accurately delivering large quantities of a fire extinguishing material to a forest fire in rugged terrain.

SUMMARY OF THE INVENTION

It is the object of the present invention to fill this need. The present invention provides a self-contained vehicle which has both a water cannon and a water source. The water or other extinguishing material is carried in large tanks on the vehicle, so the vehicle is free to fight fires at a great distance from another water source. The vehicle is pushed and powered by a track driven tractor vehicle such as a bulldozer, which also pulls a trailer containing reserve water tanks and a reserve pump and hose. The operators of the vehicle are safely protected from the fire within the protective cabs of the vehicle. The vehicle travels on crawler tracks and sheepfoot wheels, which are impervious to heat, and which travel easily over very rough terrain.

The vehicle is equipped with a pump and hose combination water cannon for shooting the water at great distances. The nozzle of the cannon swivels, and is mounted on a boom which telescopes, elevates, and rotates. The stream of water can thereby be delivered with great accuracy, as the nozzle may be brought into close proximity with burning material not otherwise reachable. The hose may be lengthened with extension pieces to accommodate the telescoping boom, and is equipped with a valve for preventing water flow while the extension pieces are inserted. The vehicle is also equipped with a telescoping, rotating, and elevating floodlight system, which enables the operator to see at night or in heavy smoke.

Therefore, to the accomplishments of the foregoing objects, the invention consists of the foregoing features hereinafter fully described and particularly pointed out in the claims, the accompanying drawings and following disclosure describing in detail the invention, such drawings and disclosure illustrating, however, but one of the various ways in which the invention may be practiced.

DESCRIPTION OF THE PREFERRED EMBODIMENT

Figure 1:
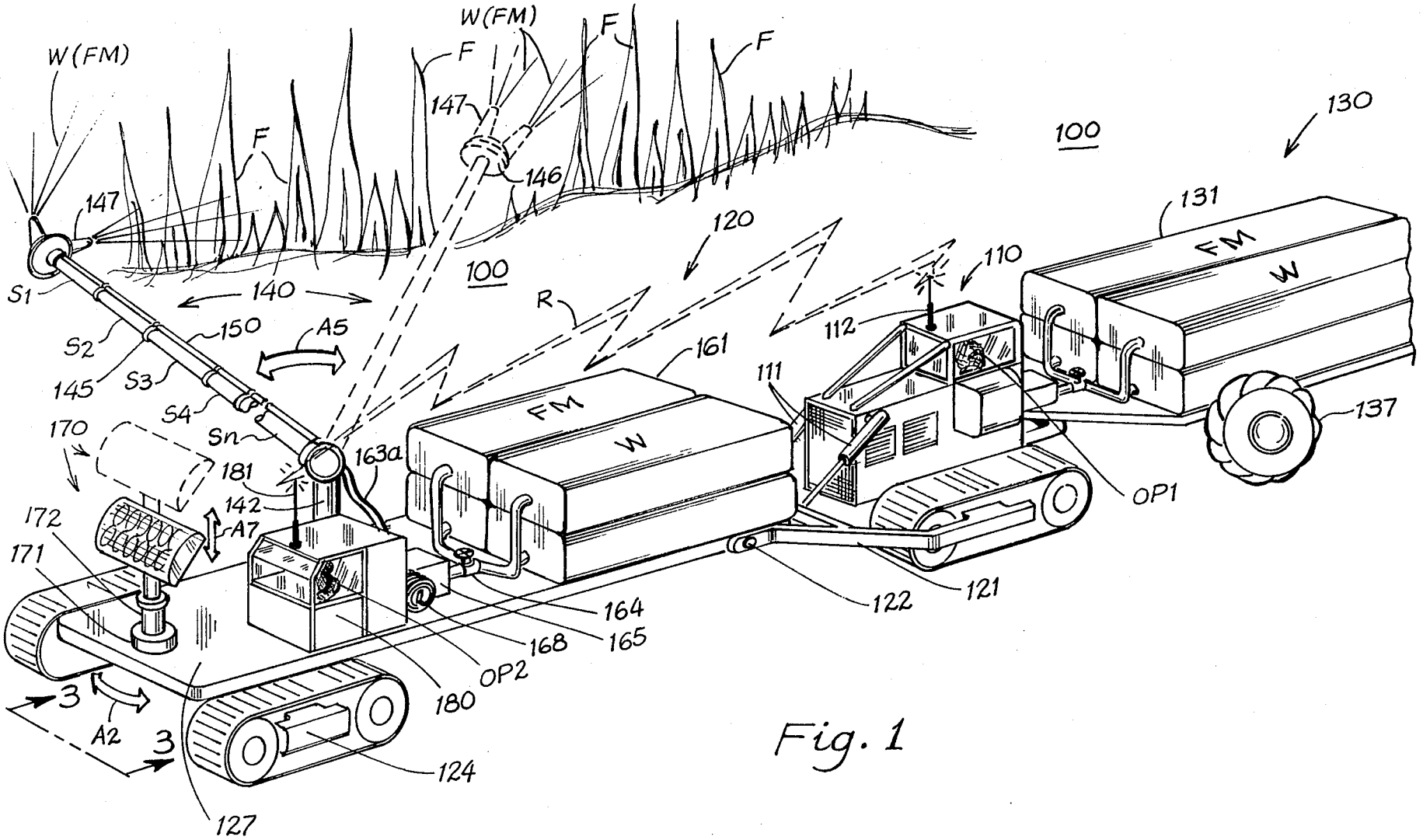
FIG. 1 is an elevated perspective view of the firefighting vehicle, illustrating the front platform vehicle, tractor vehicle, and rear platform vehicle engaged in fighting a fire.

Turning now to FIG. 1, the three vehicle components of the firefighting vehicle 100 of the present invention are shown: the front platform vehicle 120, the tractor vehicle 110, and the rear platform vehicle 130.

Figure 2:
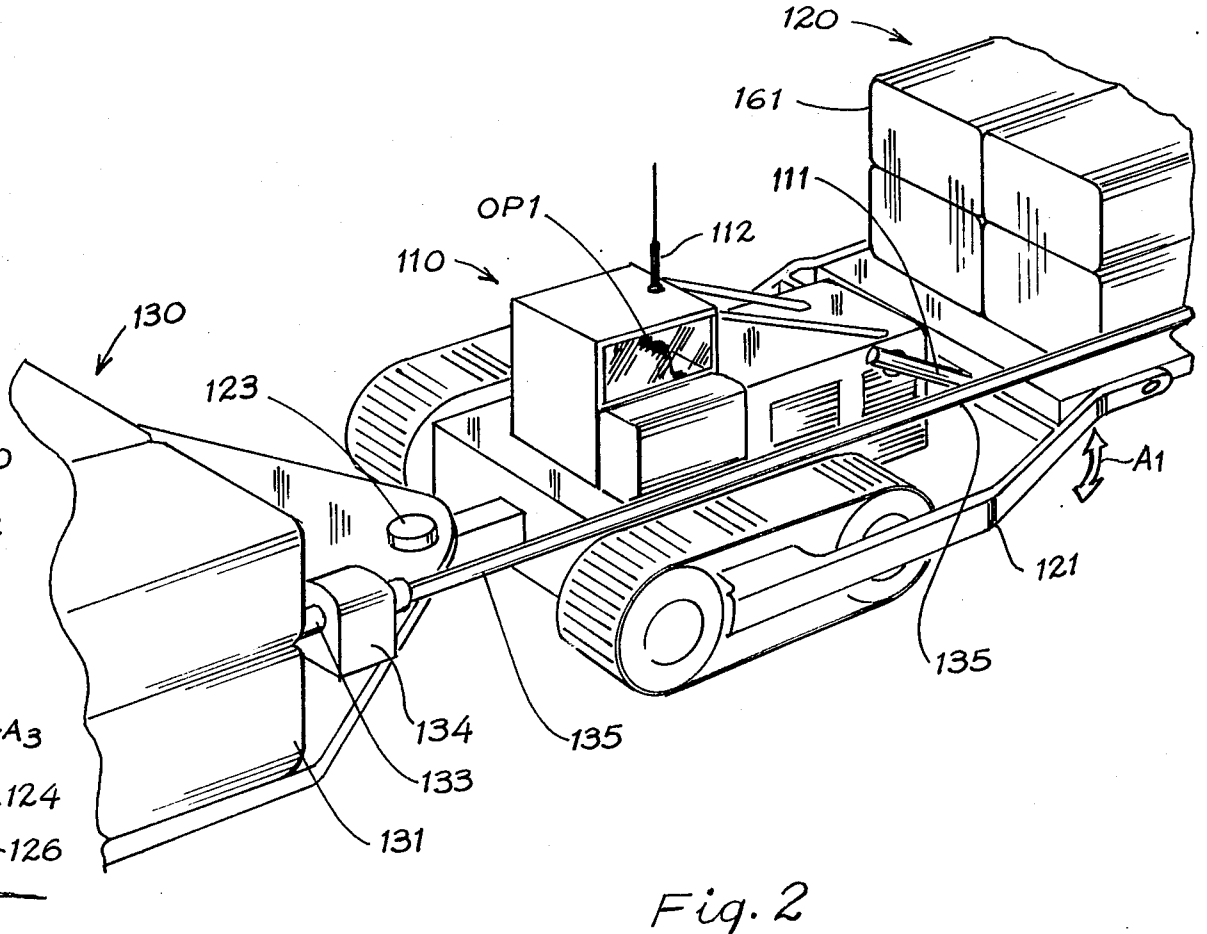
FIG. 2 is an elevated perspective view of the vehicle, illustrating the hitches which couple the front and rear platform vehicles to the tractor vehicle.

FIGS. 1 and 2 illustrate how the front platform vehicle 120 is attached to the tractor vehicle 110 by two-point pushing hitch which consists of sidearms 121 attached to each side of the front platform vehicle 120 at one end and to each side of the tractor vehicle 110 at the other end. The sidearms 121 are attached to the front platform vehicle 120 by way of pivoting attachment means 122, which, in the best mode contemplated, are cylindrical pins which slide into holes in the sidearms 121 and are reinforced to sustain being pushed upon with a full load on platform 120. The sidearms 121 support the rear end of the front platform vehicle 120 and are coupled to hydraulic lifting arms 111 on the tractor, which can, by raising or lowering the sidearms 121 with motion Al, maintain the level balance of the front platform vehicle 120 on a sloping terrain. A jack stand (not shown) may be provided to support platform vehicle 120 when not attached to tractor 110. The rear platform vehicle 130 is attached to the tractor vehicle 110 by a standard one-point pulling hitch 123.

Figure 3:
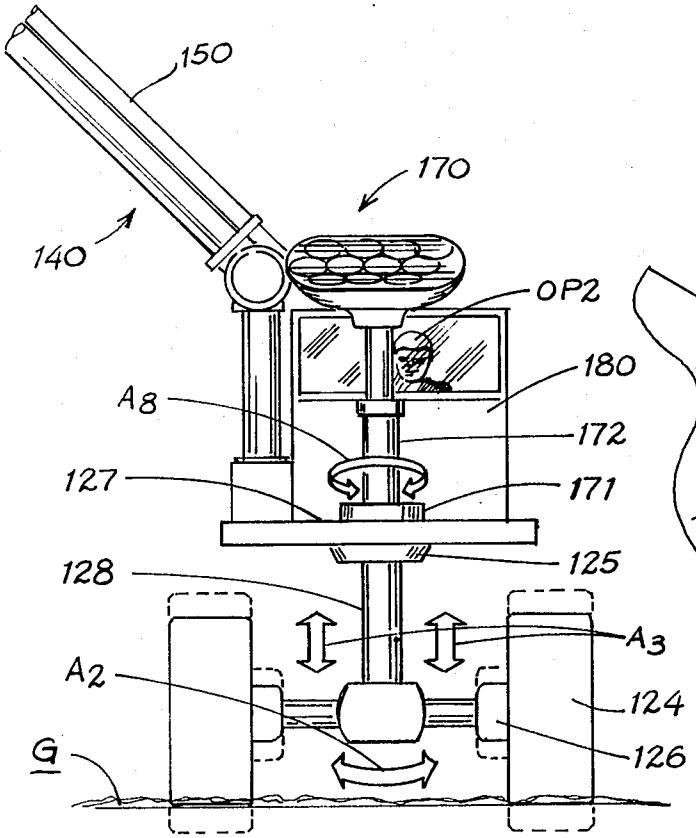
FIG. 3 is a front view taken along the line 3—3 of FIG. 1 of the front platform vehicle, illustrating the operation of the steerable tracks.

The nose of the front platform vehicle 120 is supported by steerable tracks 124, as shown in FIGS. 1 and 3. The tracks 124 are mounted to an elevation shaft 128, which is mounted to the underside of the bed 127 of the front platform vehicle 120 with a turntable 125, allowing the tracks 124 to be rotated with motion A2. The tracks 124 have suspension means 126 which allow parts of each track 124 to rise and fall with motion A3 when the track 124 traverses uneven terrain G, allowing the track 124 as a whole to avoid having motion A3, so that the front platform vehicle 120 travels smoothly even on rough terrain G.

Figure 4:
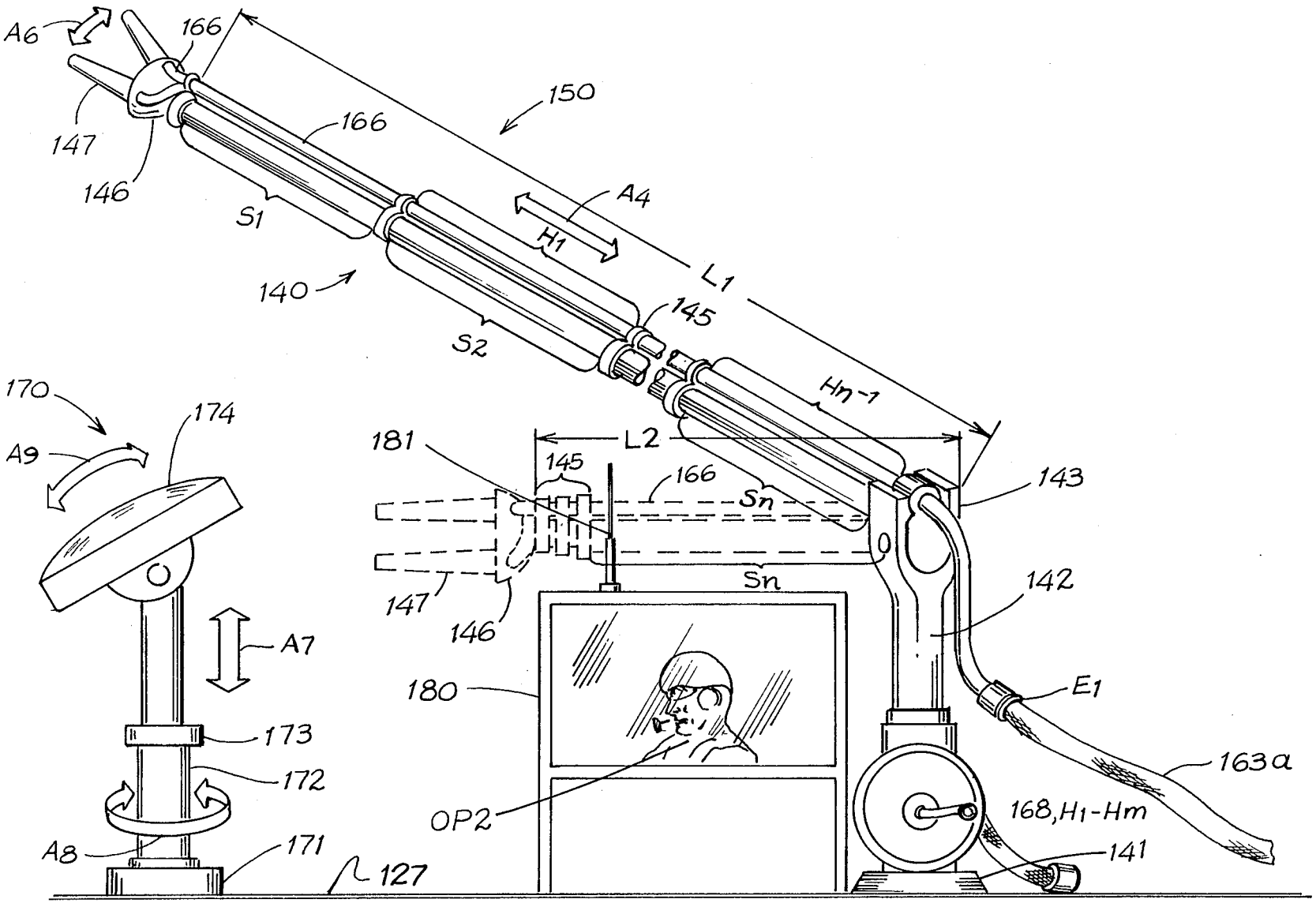
FIG. 4 is a side view of the boom, cab, and floodlight of the front platform vehicle and the transfer means for distributing the fire extinguishing material from the reserve tanks to the front platform.

FIGS. 1, 3 and 4 illustrate the telescopically extendible boom 140 of the front platform vehicle 120. The boom 140 is mounted to the topside of the bed 127 with a turntable base 141. A support shaft 142 is vertically connected to the turntable base 141 so as to rotate with the turntable base 141. The upper end of the support shaft 142 has a hinge 143, to which is attached the lower end of the lowermost telescopic extension section member Sn of a plurality of extension section members S1–Sn. The rotation of the turntable base 141 imparts motion A5 to the boom 140. The extension section members S1–Sn telescope with motion A4. Each extension section member S1–Sn is adapted with a hose guide ring 145 which keeps firehoses, generally designated 150, supported and attached to the boom 140. The upper end of the uppermost extension section member S1 is adapted with a servo nozzle swivel means 146 which swivels with motion A6 responsive to remote controls. Finally, the boom 140 terminates in a high pressure nozzle 147, which is attached to the servo nozzle swivel means 146 so that operator OP2 can aim the flow of fire extinguishing material W, FM.

Figure 5:
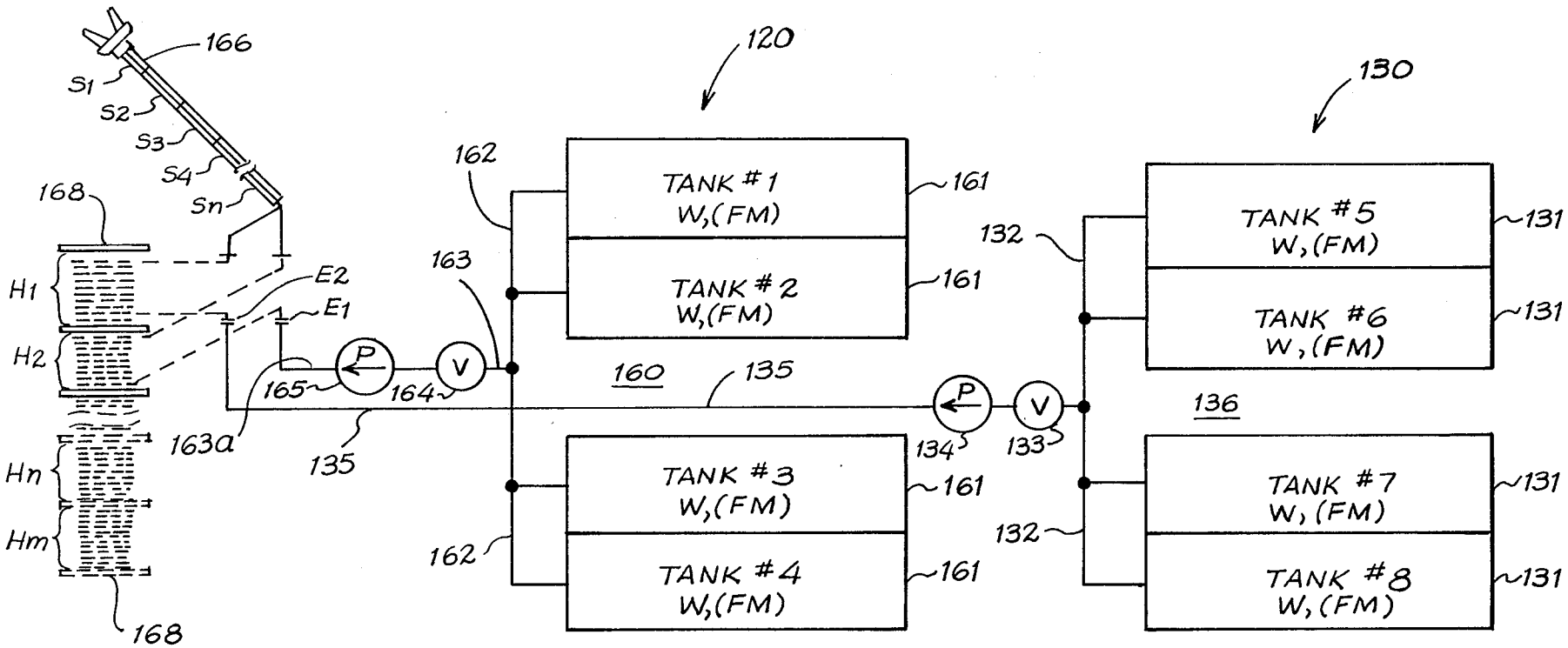
FIG. 5 is a schematic diagram of the water delivery systems of the vehicle.

The high pressure nozzle 147 is fed a fire extinguishing substance, generally designated W or FM, for putting out a fire F, as shown in FIG. 1. In the best mode contemplated, the substance W may be either water, specifically designated W, or some other substance such as a foaming material FM. The invention will hereinafter be described as delivering water W, but this is for convenience only, and should not be interpreted as limiting the scope of the invention to one only capable of delivering water W. The main water delivery system 160 is schematically illustrated in FIG. 5 provided with a plurality of front tanks 161, mounted on the front platform vehicle 120, for holding the water W. In the best mode contemplated, the front platform vehicle 120 is equipped with four such front tanks 161.

The water W leaves the front tanks 161 into front tank hoses 162. The front tank hoses 162 merge into a front primary hose inlet section 163, which is equipped with a front valve 164 which can be adjusted to stop or to allow the flow of water W through the front primary hose inlet section 163. When the front valve 164 is open, allowing water W to flow, the water W leaves the front valve 164 and enters a front pump 165. The front pump is mounted to the front platform vehicle 120 and forces the water W, under great pressure, to continue along the front primary hose outlet 163*a*. The front primary outlet section 163*a* terminates substantially near the hinge 143 of the boom 140, at an end E1.

The high pressure nozzle 147 is hydraulically connected to a permanently attached boom hose section 166, as shown in FIG. 4 and FIG. 5. The boom hose section 166 is long enough so that when the boom 140 is retracted to length L2, the lower end of the nozzle hose section 166 can be threaded through the hose guide rings 145 and connected to the terminal end E1 of the front primary hose outlet section 163*a*.

However, as the boom 140 is extended, hose extension sections H1–Hm must be added, in order for the boom 140 to attain its full extension length L1 without snapping the firehoses 150. The number of hose extension sections Hm is greater than the number of boom extension section members Sn to accommodate spare hoses. To add the first firehose section H1, the front platform operator OP2 closes the front valve 164 to stop the water W from flowing, uncouples the end E1 of the front primary hose section outlet section 163*a* from the lower end of boom hose section 166, and couples the respective ends of hose extension section H1 to the front primary hose section outlet section 163*a* and the boom hose section 166. The hose extension sections H1–Hm are stored on the front platform vehicle 120 on hose storage devices 168. In the best mode contemplated, the hose storage devices 168 are spring Operated takeup reels. As the boom 140 is telescoped, it will pull the hose sections H1–Hm as required through the hose guide rings 145, much like fishing line being pulled through the guides on a fishing rod. The front valve 164 is then opened, allowing water W to flow again. As the boom 140 is extended further, additional hose extension sections H2–Hm may be required. The process for inserting them is the same, except that they will be inserted between the front primary hose outlet section 163*a* and the most recently inserted hose extension section, rather than between the front primary hose outlet section 163*a* and the boom hose section 166, which will have been pulled entirely up the boom 140.

Conversely, as the boom 140 is lowered, the firehoses 150 must be shortened, to keep them from kinking. The process is merely the reverse of the insertion process just described. The front valve 164 is closed, the boom 140 lowered, the lowermost hose extension section are removed, the front primary hose outlet section 163*a* is reconnected, and the front valve 164 is again opened.

As best seen in FIGS. 1, 3, and 4, the front platform vehicle 120 is also equipped with a floodlamp system 170, which is attached to the bed 127 on a lamp rotary base means 171 which can be controlled by OP2 to rotate with motion A8. A telescopic lamp extension means 172 is attached to the lamp rotary base means 171, and can telescope up and down with motion A7. The lamp extension means 172 is adapted with a lamp tilt 173 which can tilt with motion A9 responsive to OP2's commands A lamp 174 is attached to the lamp tilt 173, and provides light which can be aimed by imparting motions A8 and A9 via the rotary base means 171 and lamp tilt 173. In the best mode contemplated, the lamp 174 is a high power floodlamp which enables the front platform operator OP2 to see at night or in thick smoke.

The front platform vehicle 120 is equipped with a cab 180, which safely protects the front platform operator OP2 from the fire F. In the best mode contemplated, the cab 180 is equipped with controls which allow the operator OP2 to control the boom 140 and the floodlamp system 170, and to steer the tracks 124. The operator OP2 has separate control over the turntable base 141, hinge 143, telescopic extension section members S1–Sn, and servo nozzle swivel means 146 of the boom 140. The operator OP2 also has separate control over the rotary base means 171 and lamp tilt 173 and telescopic lamp extension means 172 of the floodlamp system 170. In the best modes contemplated, the controls may be standard hydraulic controls or electric controls.

The cab 180 is also equipped with communication means 181 as shown in FIG. 1, which allow the operator OP2 to communicate with others not in the cab 180. In the best mode contemplated, the communication means 181 is a two-way radio, and the tractor vehicle 110 is equipped with similar communication means 112 so that the front platform operator OP2 may communicate with the tractor operator OP1, as shown by radio waves R.

As FIGS. 1, 2 and 5 illustrate, the rear platform vehicle 130 is equipped with rear tanks 131, rear tank hoses 132, a rear valve 133, a rear pump 134, and a rear primary hose 135 with a terminal end E2. The plurality of tanks 131 comprise an auxiliary or reserve water delivery system 136, and are connected similarly to the elements of the main water delivery system 160. In the best mode contemplated, the rear platform vehicle 130 is equipped with four rear tanks 131. As shown in FIG. 2, the rear primary hose 135 extends from the rear platform vehicle 130 across the tractor vehicle 110, and onto the front platform vehicle 120, terminating substantially near the hinge 143 of the boom 140, as does the front primary hose outlet section 163*a*. The front platform operator OP2 can switch between the water delivery systems 160 and 136 by closing both valves 164 and 133, disconnecting the currently attached primary hose 163 or 135, connecting the other primary hose 135 or outlet section 163*a*, and opening the other valve 133 or 164. As shown in FIG. 1, the rear platform vehicle 130 is support by and travels on a plurality of wheels 137, which are adapted for use on high-temperature terrain. In the best mode contemplated, the wheels 137 are all-metal wheels known as sheepfoot wheels.

Therefore, while the present invention has been shown and described herein in what is believed to be the most practical and preferred embodiments, it is recognized that departures can be made therefrom within the scope of the invention, which is therefore not to be limited to the details disclosed herein but is to be accorded the full scope of the claims so as to embrace any and all equivalent apparatus.

We claim:

1. A firefighting apparatus for use in fighting fires in remote, rough terrain, said firefighting apparatus comprising:

(a) motorized tracked vehicle;

(b) platform means, said platform means being propelled by said motorized tracked vehicle and being adapted with a cab member for housing controls and protecting an operator from fire dangers, steerable track means for guiding said platform means by said operator, tank means for storing a large volume of fire extinguishing substance, hose system means connected to said tank means, multi-directionally adjustable fire extinguishing substance delivery means connected to said hose system for delivering said fire extinguishing substance to a fire being fought.

2. A firefighting apparatus for use in fighting fires in remote, rough terrain as recited in claim 1, wherein said platform means includes hitch means for being pushed by said motorized tracked vehicle.

3. A firefighting apparatus for use in fighting fires in remote, rough terrain as recited in claim 2, wherein:

(a) said platform means includes being designated a front platform means; and (b) said firefighting apparatus further comprising a rear platform means adapted with a plurality of wheel members for use on terrain having hot ash materials, hitch means for being drawn by said motorized tracked vehicle, reserve tank means for storing reserve volume of said fire extinguishing substance and a fire extinguishing substance transfer system for delivering said fire extinguishing substance forwardly to said hose system means.

4. A firefighting apparatus for use in fighting fires in remote, rough terrain as recited in claim 3, wherein:

said front platform means includes a multi-directionally adjusted lamp means for lighting the fire area being fought and lamp control means for remotely controlling said lamp means.

5. The firefighting apparatus of claim 3 wherein each of said tank means and said reserve tank means includes:

at least one pump means for pumping said fire extinguishing substance to said hose system means; and at least one valve means for controlling flow of said fire extinguishing substance to said hose system means and for facilitating adding sections of hoses as required.

6. A firefighting apparatus of claim 1 wherein said hose system means includes:

a permanently attached boom hose section, said boom hose section having an inlet end for being hydraulically connectable to said tank means and then to said reserve tank means as required; and a plurality of reserve hose sections mounted on retractable reels, each of said plurality of reserve hose sections having inlet ends and for being hydraulically connected to said tank means and then to said reserve tank means as required and outlet ends for hydraulically connecting to said boom hose section and then to inlet ends of respective ones of said plurality of reserve hose sections as required, said plurality of hose sections for adjustably adapting to said multi-directionally adjustable fire extinguishing substance delivery means.

7. A firefighting apparatus of claim 1 wherein said multi-directionally adjustable delivery means includes:

(a) a extendible boom means adapted with a plurality of extension section members, each of said extension section members being adapted with at least one hose guide ring means for threading hose sections from said hose system means in parallel alignment to said boom means and a nozzle servo means for directing the flow of said fire extinguishing substance onto flames of a fire being fought;

(b) a permanently attached boom hose section for being hydraulically connected to said tank means;

(c) a high pressure nozzle means mechanically mounted to said nozzle servo means and hydraulically connected to an outlet end of said permanently attached boom hose section for extending flow of said fire extinguishing substance a substantial distance toward flames of a fire being fought; and (d) turntable base means for rotatably mounting a base end of said extendible boom means to a top side of said platform means.

8. The firefighting apparatus of claim 7 wherein said controls housed in said cab member includes:

(a) control means for remotely controlling said multi-directionally adjustable fire extinguishing substance delivery means, including extending said extendible boom means and directing said high pressure nozzle means mounted to said nozzle servo means towards a flame intense area, steering said platform means and controlling a lamp means mounted to said platform means; and (b) communication means for receiving and transmitting instructions from remote personnel including an operator of the motorized tracked vehicle.

9. The firefighting apparatus of claim 1 wherein said steerable track means further includes:

a plurality of crawler tracks pivotally mounted to a bottom side of said platform means and being adapted with suspension means for compensating for irregularities in the terrain where the fire is being fought.

10. A firefighting apparatus for use in fighting fires in remote, rough terrain, said firefighting apparatus comprising:

(a) a motorized tracked vehicle;

(b) a front platform means, said front platform means being pushed by said motorized tracked vehicle and being adapted with a cab member for housing controls and protecting an operator from fire dangers, steerable track means for guiding said platform means by said operator, tank means for storing a large volume of fire extinguishing substance, hose system means connected to said tank means, multi-directionally adjustable fire extinguishing substance delivery means connected to said hose system for delivering said fire extinguishing substance to a fire being fought; and (c) a rear platform means adapted with a plurality of wheel members for use on terrain having hot ash materials, hitch means for being drawn by said motorized tracked vehicle, reserve tank means for storing reserve volume of said fire extinguishing substance and a fire extinguishing substance transfer system for delivering said fire extinguishing substance forwardly to said hose system means.

11. A firefighting apparatus for use in fighting fires in remote, rough terrain as recited in claim 10, wherein:

said front platform means includes a multi-directionally adjusted lamp means for lighting the fire area being fought and lamp control means for remotely controlling said lamp means.

12. The firefighting apparatus of claim 10 wherein each of said tank means and said reserve tank means includes:

at least one pump means for pumping said fire extinguishing substance to said hose system means; and at least one valve means for controlling flow of said fire extinguishing substance to said hose system means and for facilitating adding sections of hoses as required.

13. A firefighting apparatus of claim 10 wherein said hose system means includes:

a permanently attached boom hose section, said boom hose section having an inlet end for being hydraulically connectable to said tank means and then to said reserve tank means as required; and a plurality of reserve hose sections mounted on retractable reels, each of said plurality of reserve hose sections having inlet ends and for being hydraulically connected to said tank means and then to said reserve tank means as required and outlet ends for hydraulically connecting to said boom hose section and then to inlet ends of respective ones of said plurality of reserve hose sections as required, said plurality of hose sections for adjustably adapting to said multi-directionally adjustable fire extinguishing substance delivery means.

14. A firefighting apparatus of claim 10 wherein said multi-directionally adjustable delivery means includes:

(a) a extendible boom means adapted with a plurality of extension section members, each of said extension section members being adapted with at least one hose guide ring means for threading hose sections from said hose system means in parallel alignment to said boom means and a nozzle servo means for directing the flow of said fire extinguishing substance onto flames of a fire being fought;

(b) a permanently attached boom hose section for being hydraulically connected to said tank means;

(c) a high pressure nozzle means mechanically mounted to said nozzle servo means and hydraulically connected to an outlet end of said permanently attached boom hose section for extending flow of said fire extinguishing substance a substantial distance toward flames of a fire being fought; and (d) turntable base means for rotatably mounting a base end of said extendible boom means to a top side of said platform means.

15. The firefighting apparatus of claim 14 wherein said controls housed in said cab member includes:

(a) control means for remotely controlling said multi-directionally adjustable fire extinguishing substance delivery means, including extending said extendible boom means and directing said high pressure nozzle means mounted to said nozzle servo means towards a flame intense area, steering said platform means and controlling a lamp means mounted to said platform means; and (b) communication means for receiving and transmitting instructions from remote personnel including an operator of said motorized tracked vehicle.

16. The firefighting apparatus of claim 10 wherein said steerable track means further includes:

a plurality of crawler tracks pivotally mounted to a bottom side of said front platform means and being adapted with suspension means for compensating for irregularities in the terrain where the fire is being fought.

17. A method of fighting fires in remote rough terrain, said method comprising the steps of:

(a) providing a firefighting apparatus adapted for manuevering in rough terrain and for carrying large volume of fire extinguishing materials, said firefighting apparatus comprising a motorized tracked vehicle, a firefighting front platform means for being pushed by said motorized tracked vehicle and a rear platform vehicle for carrying reserve tanks containing fire extinguishing material and for being drawn by said motorized tracked vehicle;

(b) preparing said firefighting apparatus for fighting a fire in remote rough terrain by fully loading all provided tanks on said front and rear platform means with fire extinguishing substance and verifying that all functional parts of said apparatus are operational;

(c) transporting at least one of said prepared firefighting apparatus to a particular remote area in response to a fire alarm and request for assistance;

(d) manning add arranging in tandem said front platform means, said motorized tracked vehicle and said rear platform vehicle in preparation for fighting a fire;

(e) maneuvering said front platform means by controlling track means provided on said front platform means in response to being pushed by said motorized tracked vehicle towards a fire zone;

(f) hydraulically connecting a hose system to an outlet end of a tank means containing fire extinguishing substance and to an inlet end of a multi-directionally adjustable fire extinguishing substance delivery means;

(g) fighting a raging fire by maneuvering and delivering fire extinguishing substance from said delivery means onto flames of said raging fire; and (h) connecting said delivery means to reserve tanks on said rear platform means whenever the fire extinguishing substance in the tanks in the front platform means has been used up to facilitate continued fighting said raging fire.

18. A method of fighting fires in remote rough terrain as recited in claim 17 wherein said step of providing said firefighting apparatus further comprises:

adapting said front platform means with a cab member for housing controls and protecting an operator from fire dangers, with steerable track means for guiding said platform means by said operator, with tank means for storing a large volume of fire extinguishing substance, with hose system means connected to said tank means, with multi-directionally adjustable fire extinguishing substance delivery means connected to said hose system for delivering said fire extinguishing substance to a fire being fought; and adapting said rear platform means with a plurality of wheel members for use on terrain having hot ash materials, with hitch means for being drawn by said motorized tracked vehicle, with reserve tank means for storing reserve volume of said fire extinguishing substance and with a fire extinguishing substance transfer system for delivering said fire extinguishing substance forwardly to said hose system means.

19. A method of fighting fires in remote rough terrain as recited in claim 18 wherein said step of hydraulically connecting said hose system further comprises the steps of:

hydraulically connecting a permanently attached boom hose section to said tank means and then to said reserve tank means as required, said multi-directionally adjustable fire extinguishing substance delivery means having an extendible boom means in a minimum length position; and hydraulically connecting a plurality of reserve hose sections mounted on retractable reels to said tank means and to said permanently attached boom hose section according to added boom length.

* * * * *